US005509253A

United States Patent [19]

Cappi et al.

[11] Patent Number: 5,509,253

[45] Date of Patent: Apr. 23, 1996

[54] PROCESS AND APPARATUS FOR WRAPPING ARTICLES WITH STRETCHABLE FILM

[75] Inventors: Angelo Cappi, vignola; Renato Rimondi, Bazzano, both of Italy

[73] Assignee: A.W.A.X. Progetazione e Ricerca S.r.l., Italy

[21] Appl. No.: 228,096

[22] Filed: Apr. 14, 1994

[30] Foreign Application Priority Data

Apr. 16, 1993 [IT] Italy ..... B093A0156

[51] Int. Cl.[6] ..... B65A 41/00

[52] U.S. Cl. ..... 53/441; 53/504; 53/556; 53/389.2

[58] Field of Search ..... 53/441, 504, 556, 53/503, 66, 77, 141, 67, 74, 168, 389.2; 493/23, 25, 53

[56] References Cited

U.S. PATENT DOCUMENTS

| | | | |
|---|---|---|---|
| 3,967,433 | 7/1976 | Bonfiglioli | 53/441 |
| 4,543,766 | 10/1985 | Boshinski | 53/504 |
| 4,709,531 | 12/1987 | Denda | 53/441 |
| 4,905,451 | 3/1990 | Jaconelli et al. . | |
| 5,103,621 | 4/1992 | Matsumoto | 53/587 |
| 5,157,903 | 10/1992 | Nakashima et al. . | |
| 5,203,136 | 4/1993 | Thimon et al. | 53/141 |

FOREIGN PATENT DOCUMENTS

| | | |
|---|---|---|
| 0340157 | of 1989 | European Pat. Off. . |
| 0300855 | 1/1989 | European Pat. Off. . |
| 0434947 | 7/1991 | European Pat. Off. . |

*Primary Examiner*—John Sipos
*Assistant Examiner*—Gene L. Kim
*Attorney, Agent, or Firm*—Larson and Taylor

[57] ABSTRACT

The film (F) fed to the packaging machine has a width suitable for wrapping articles whose sizes may vary over a wide range, and its width is made proportionate to the largest size of article which the machine can wrap. For the wrapping of articles whose dimensions are smaller than the maximum ones acceptable by the machine, the width of the film is modified as required to suit the dimensions of the article to be wrapped, by a pleating process (9-12-112-29-129-229) such that the longitudinal axis of the pleats lies in the direction of the length of the section of film introduced into the wrapping station.

11 Claims, 5 Drawing Sheets

PROCESS AND APPARATUS FOR WRAPPING ARTICLES WITH STRETCHABLE FILM

DESCRIPTION

The invention relates to a process and apparatus to enable a machine for wrapping articles with stretchable film to form packages which are automatically made proportionate to the sizes of the articles, and also relates to the packages made by this process.

In packaging machines of a known type, the wrapping film is unreeled from a roll, and its width is generally made proportionate to the smallest dimensions of the articles to be wrapped, so that random, disordered and excessive superimpositions of flaps of film are not formed on the bottom of articles of small size, to avoid problems of an aesthetic and possibly functional nature, particularly in respect of the heat sealing of the base of the wrapping, which is particularly necessary in the packaging of articles such as meat, which may release liquid components over a period of time. The greater widths of film necessary for the wrapping of articles whose width or length is greater than the width of the film are obtained by subjecting the film to a suitable transverse pre-stretching, in proportion to the sizes of the article to be wrapped.

However, it is evident that such a condition limits the capacity of the machine to operate on articles whose sizes vary over a wide range; this is contrary to the present market requirement for machines capable of operating automatically on articles of widely differing sizes without the necessity of adjustments and changes of format of the wrapping film.

With the known machines and processes, the packages of articles of very large size are made from highly stretched film which is consequently less able to perform the chemical and physical functions required of it.

The invention is intended to overcome these difficulties with the following idea for a solution. The film fed to the packaging machine has a width suitable for wrapping articles whose sizes may vary over a wide range, and its width is made proportionate to the largest size of article which the machine can wrap. For the wrapping of articles whose dimensions are smaller than the maximum ones acceptable by the packaging machine, the width of the film is modified as required to suit the dimensions of the article to be wrapped, by a pleating process, such that the longitudinal axis of the pleats lies in the direction of the length of the section of film introduced into the wrapping station and such that, when wrapping articles of smaller size, the formation of a sufficiently stretched and tight wrapping is still ensured.

Preferably, this pleating operation is performed before the film enters the wrapping station, by means of suitable variable pleating means controlled by the means which measure the size of whatever article is fed to the lifting surface of the packaging machine.

Further characteristics of the invention, and the advantages derived therefrom, will be clearly understood from the following description of some preferred embodiments of the invention, illustrated solely by way of example and without restriction in the figures on the five attached sheets of drawings, in which FIG. 1 is a top plan view of the wrapping station of one of the machines for which the process according to the invention is particularly designed;

Figure 1:
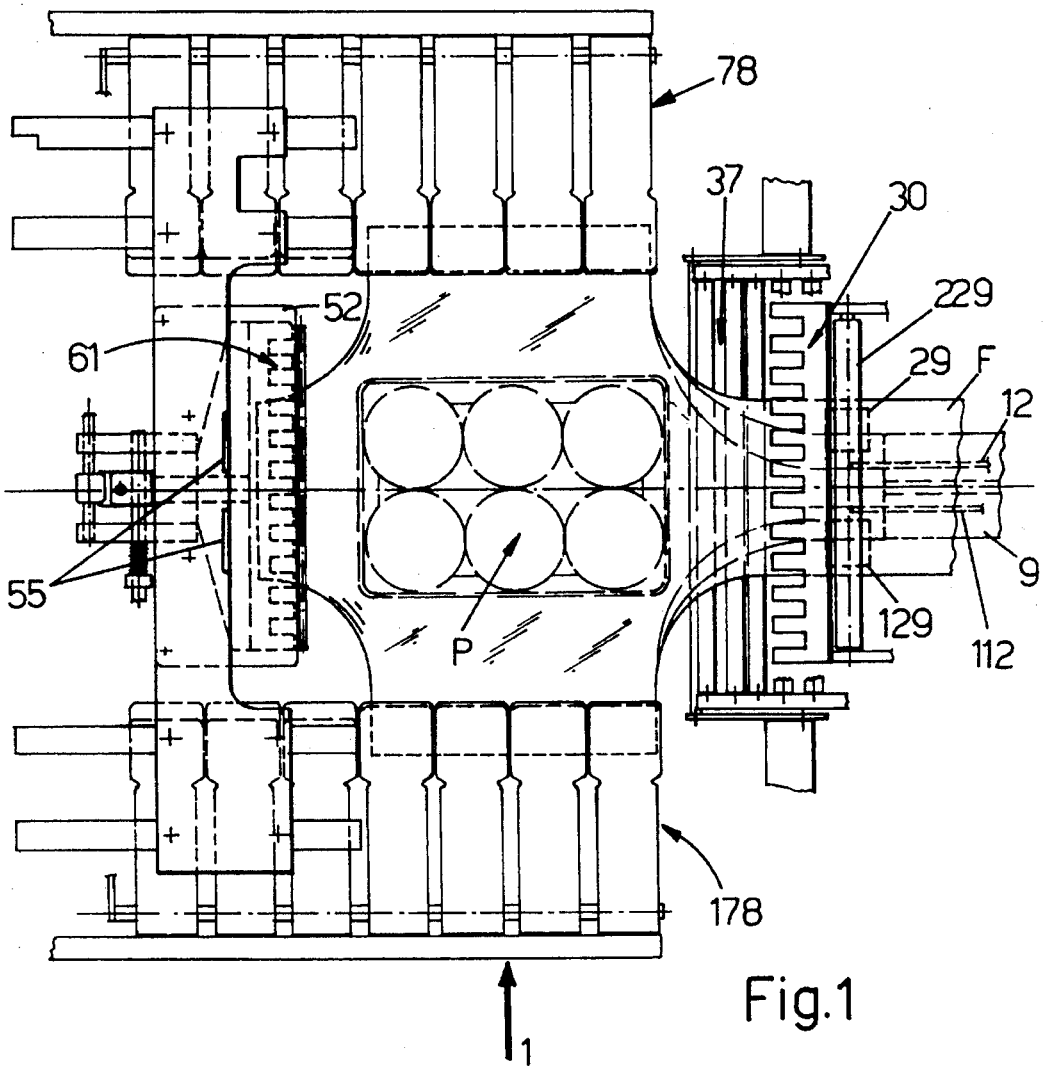
Figure 5:
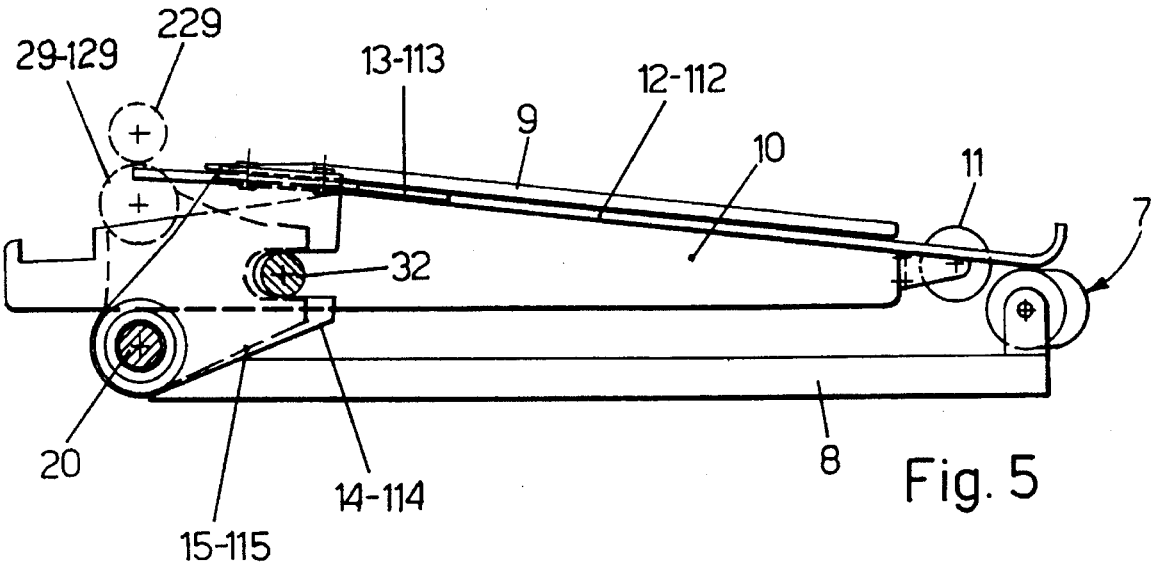
FIG. 5 shows further details of the pleating device in transverse section along the line V—V in FIG. 4.
Figure 2:
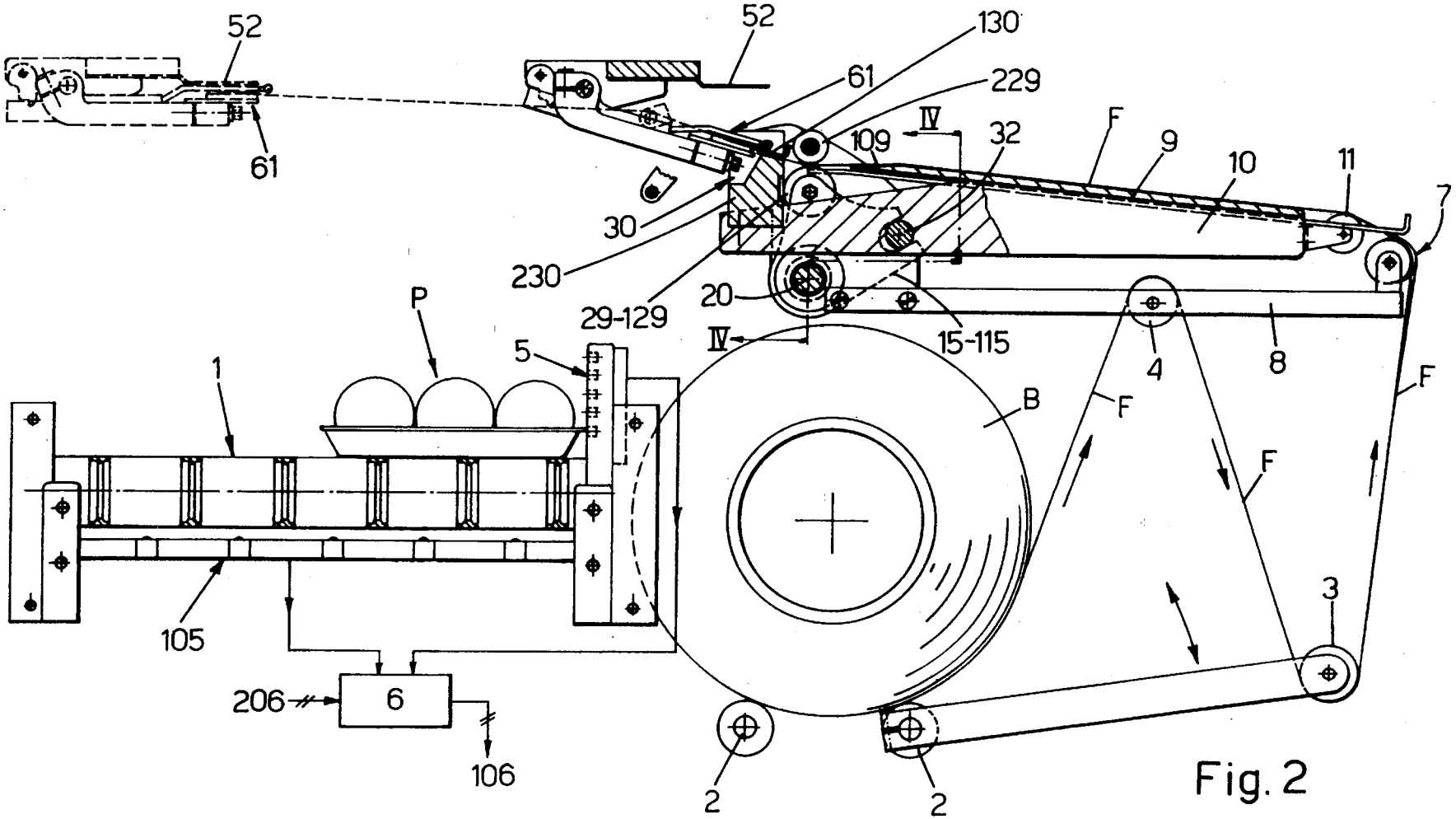
FIG. 2 is a side elevation in partial section of the wrapping station shown in FIG. 2, with the film pleating device according to the invention.
Figure 3:
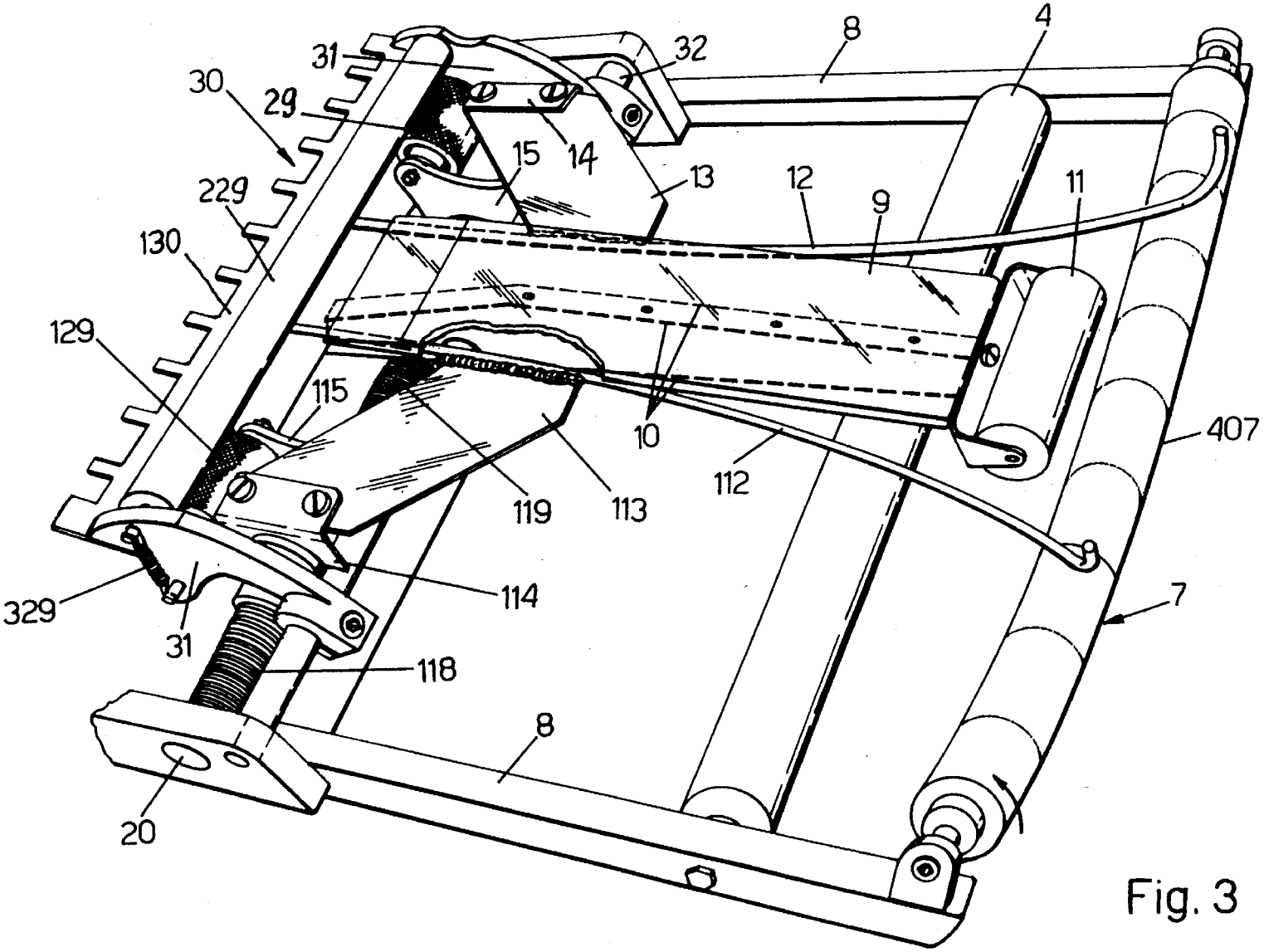
FIG. 3 is a perspective view of a possible embodiment of the wrapping film pleating device.

FIGS. 1 and 2 show schematically, and purely as an example of an industrial application of the invention, the wrapping station of a machine protected by Italian patent application No. GE93A000028 in the name of the present applicant, in which a section of film F is cyclically unreeled from a roll B and is extended at the wrapping station, with a section of length proportionate to the size and characteristics of the article P to be wrapped, which, before being introduced into the wrapping station by the appropriate feed conveyor 1, is scanned by at least two sets of banks 5-105 of optoelectronic sensors, which are located transversely and under and laterally with respect to the path of the article, and which, in combination with a suitable processing unit such as a computer 6, measure the three dimensions of the article, the width, height and length (s), the last of these being deduced, given the constant value of the speed (v) at which the article is being carried by the conveyor 1, from the equation (s= v.t.), where (t) is the time of shadowing of at least one of the sensors of any one of the said banks 5 and 105. With the output 106, the computer 6 controls the electric motors of the mechanisms driving the various operative units of the machine, including the electric motor of the film pleating apparatus according to the invention. The number 206 indicates an optional input terminal to supply the computer 6 with any variables relating to the characteristics of the article to be wrapped and/or any characteristics of the film used.

The film unreeled from the roll and extended at the wrapping station is held at one end by a fixed comb-like dispenser 30 and at the other end by a movable comb-like clamp 61, and a portion of this section of film, having a length proportionate to the size of the article, is, when so commanded, gripped by the side clamps 78-178 which then move away from each other to subject the film to a transverse pre-stretching whose extent is proportionate to the size of the article. In the subsequent phase of the lifting of the article P against the pre-stretched section of film, the rear clamp 61 and the dispenser 30 relax the longitudinal tension of the film by a convenient amount, and the side clamps also approach each other to attenuate the pre-stretching, and are then inserted under the article and opened to extend the side flaps of the film under the base of the article. This is followed by the intervention of the group consisting of the rear folder 52, which extends under the article a section of the film retained by the associated rear clamp 61, and the pusher 55 which pushes the article on to the front folder 37, while a further final flap of film is drawn from the fixed dispenser 30 and is extended on the base of the article, over the whole of its length, cut to size and to cover from below the side flaps and the rear flap of the wrapping film, which is released at the correct moment by the said rear clamp 61.

In this wrapping process, or in all processes having similar requirements, in order to ensure that the width of the film leaving the dispenser 30 or originating from another feed unit is automatically and on each occasion substantially equal to the width of the base of the article, and to ensure that the article can be introduced into the machine with any orientation, with the greater or smaller dimension transverse with respect to the longitudinal axis of the section of film extended at the wrapping station, the following provision is made. The roll B of the film is supported rotatably about its own axis by means of any known type, for example a pair of parallel idle rollers 2, and the rotation of the roll is controlled by braking means, not illustrated, governed by the angular position of a jockey roller 3 pivoted, for example, at the end of one of the rollers 2. The film unreeled from the roll is run around a higher idle static roller 4, parallel to the roll, and then run around the jockey roller 3 and so on to any suitable means enabling the film to advance towards the subsequent means of control, perfectly extended and free of folds. For exaple, such a means may consist of a special roller 7 formed by a plurality of side-by-side small rollers 107, mounted to rotate freely and with the interposition of bearings 207 on a curved axle 307 fixed at its ends to the same pair of supports 8 which support rotatably the ends of the roller 4, the said small rollers being covered by a single continuous adhering tubular sheath 407 of rubber and/or other suitable elastic material. The film F from the jockey roller 3 is run around the convex surface of the composite roller 7 and is extended transversely by the rotation of the elastic sheath 305.

On leaving the roller 7, an intermediate portion of the film F slides longitudinally on a flat guide 9 whose tapering end 109 extends to a short distance from the dispenser 30 and which is supported by an underlying median support 10, fixed to and projecting from the lower fixed part 230 of the dispenser 30. The edges of the guide 9 are suitably rounded, and the said guide is made of or covered with a material on which the film can slide substantially without friction. The end of the guide facing the composite roller 7 has a smooth idle roller 11, made of plastic material for example, substantially as wide as the said guide, and having the function of facilitating the movement of the film on to the guide.

Figure 4:
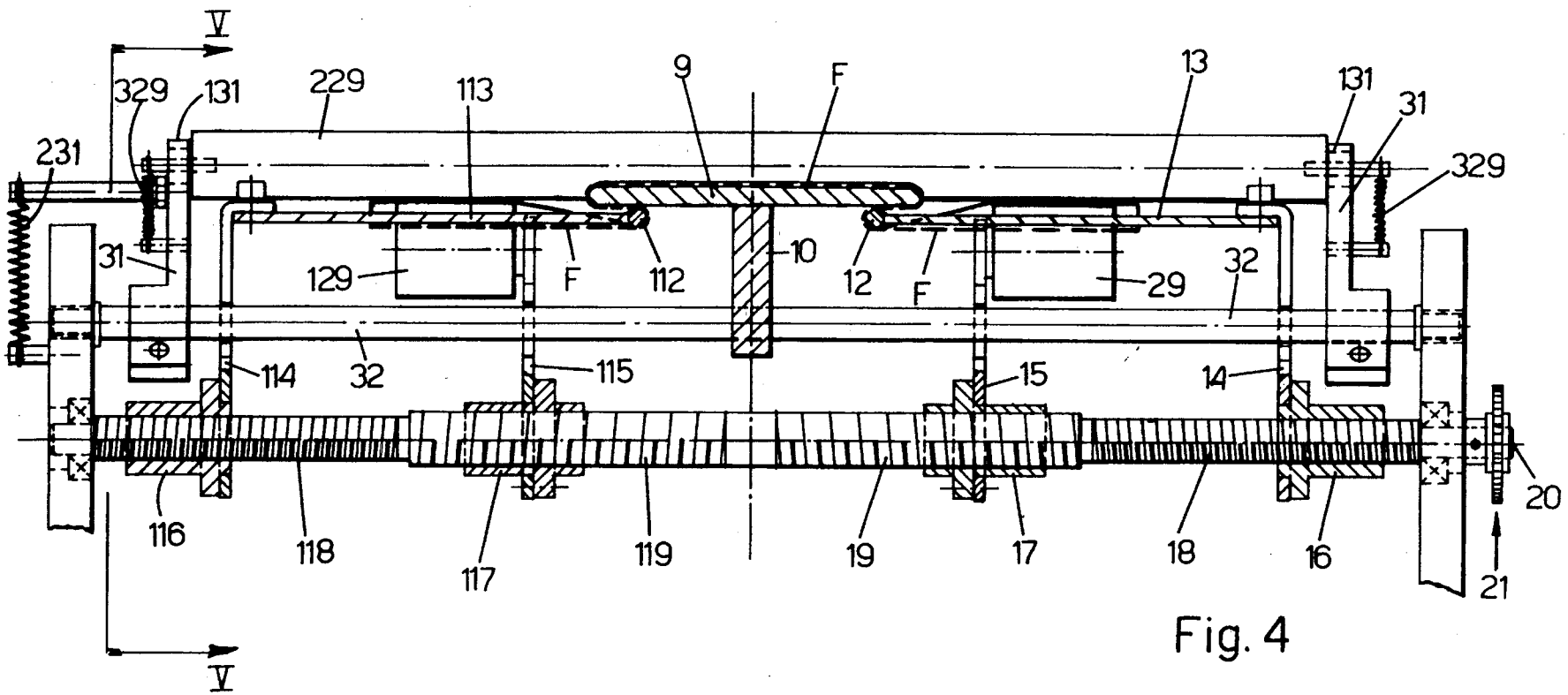
FIG. 4 shows further details of the pleating device shown in FIG. 2, in transverse section along the line IV—IV.

When seen in transverse section, as in FIG. 4, the guide 9 and the corresponding lower support 10 together form a "T" profile. Laterally with respect to the guide 9, and on either side of it, there are provided corresponding identical and symmetrically opposing side guides 12-112, made for example with sections of steel rod, which converge suitably in the direction of the dispenser 30 and which are disposed at a height suitably tower than the said guide 9. The ends of the guides 12-112 facing the roller 7 are disposed above the said roller and are suitably rounded to interact with the wrapping film and correctly guide it in. The said guides 12-112 are integral at an intermediate position with lateral outer wing-shaped parts 13-113 connected to any type of means capable of moving the said guides with a self-centring movement of approach to and with drawal from each other, controlled by the computer 6 mentioned previously. The film from the transverse extension roller 6 passes over the guide 9 and is tucked laterally under this guide by means of the side guides 12-112, in a symmetrical way, and the side flaps of the film which have not been tucked in slide under the wings 13-113. The film leaving the system of guides 9-12-112 has a transverse profile substantially in the shape of a greatly flattened "omega" capital letter, as shown in FIG. 4, and its width is substantially equal to that of the article to be wrapped.

The means described can decrease the width of the film F, but cannot widen the film up to its nominal width, and therefore the following provision is made in combination with the said means. The side flaps of the film which has left the system of guides 9-12-112 and has not yet entered the dispenser 30 bear on corresponding rollers 29-129, which are identical, axially aligned with each other, and parallel to the said dispenser and supported by self-centring means of movement, which move them in the same direction as the pleating guides 12-112, simultaneously with these but at twice the rate. The rollers 29-129 are covered with rubber or with any material having a high coefficient of friction with the film which is held on the said rollers by an idle pressure roller 229 which is disposed above them and pushed downwards by suitable elastic means, and which has a smooth surface, so that the film can slide on it substantially without friction. Purely by way of example, and without restriction, the ends of the shaft 229 pass through slots 131 provided in the pair of arms 31 which support the upper movable part 130 of the dispenser, these arms being fixed on the shaft 32 which is parallel to the dispenser and is supported rotatably by the machine frame, the said arms being pushed downwards by an elastic means 231. The ends of the roller 229 are in turn connected to springs 329 fixed to the arms 31 and pushing the said roller against the lower rollers 29-129.

According to the solution illustrated in FIGS. 2-3-4-5, the wings 13-113 are fixed on supports 14-114, while the rollers 29-129 are mounted on supports 15-115 whose forked portions slide in a guided way on the shaft 32. These supports are provided with corresponding nuts 16-116 and 17-117 which interact with the same number of threaded sections 18-118 and 19-119 of a single shaft 20, parallel to the shaft 32 and also supported rotatably at its ends by the frame of the machine, and connected to a positive motion transmission 21 driven by a geared motor system with an electronically controlled precision electric motor, not illustrated, controlled by the computer 6 mentioned with reference to FIG. 2. The threads 18-118 and 19-119 have characteristics such that they bring about the self-centring movement of the pleating guides 12-112 and of the rubber-covered rollers 29-129 in the manner stated above. When the size of the article to be wrapped changes, the computer 6 changes the distance between the parts 12-112 and 29-129 in order that the next section of film drawn from the dispenser by the movable clamp 61 (FIGS. 1 and 2) has a width substantially equal to that of the article to be wrapped, so that the final flaps of film with which the article is covered below, and which will be superimposed on each other, do not project laterally from the base of the article and do not form uncontrolled folds.

In wrapping articles of large size, the pleating guides 12-112 will be completely outside the fixed guide 9, and the film will reach the dispenser 30 with the same width as that with which it was unreeled from the roll B. The widening of the film to its greatest size is ensured by the transverse friction of the rubber-covered rollers 29-129 against the side flaps of the film, which however can slide freely over the smooth upper roller 229. These means form true clamps between which the film slides longitudinally without friction and with respect to which the film cannot move translationally because of the high friction which occurs transversely between the said film and the rubber covering of the said rollers 29-129.

Figure 6:
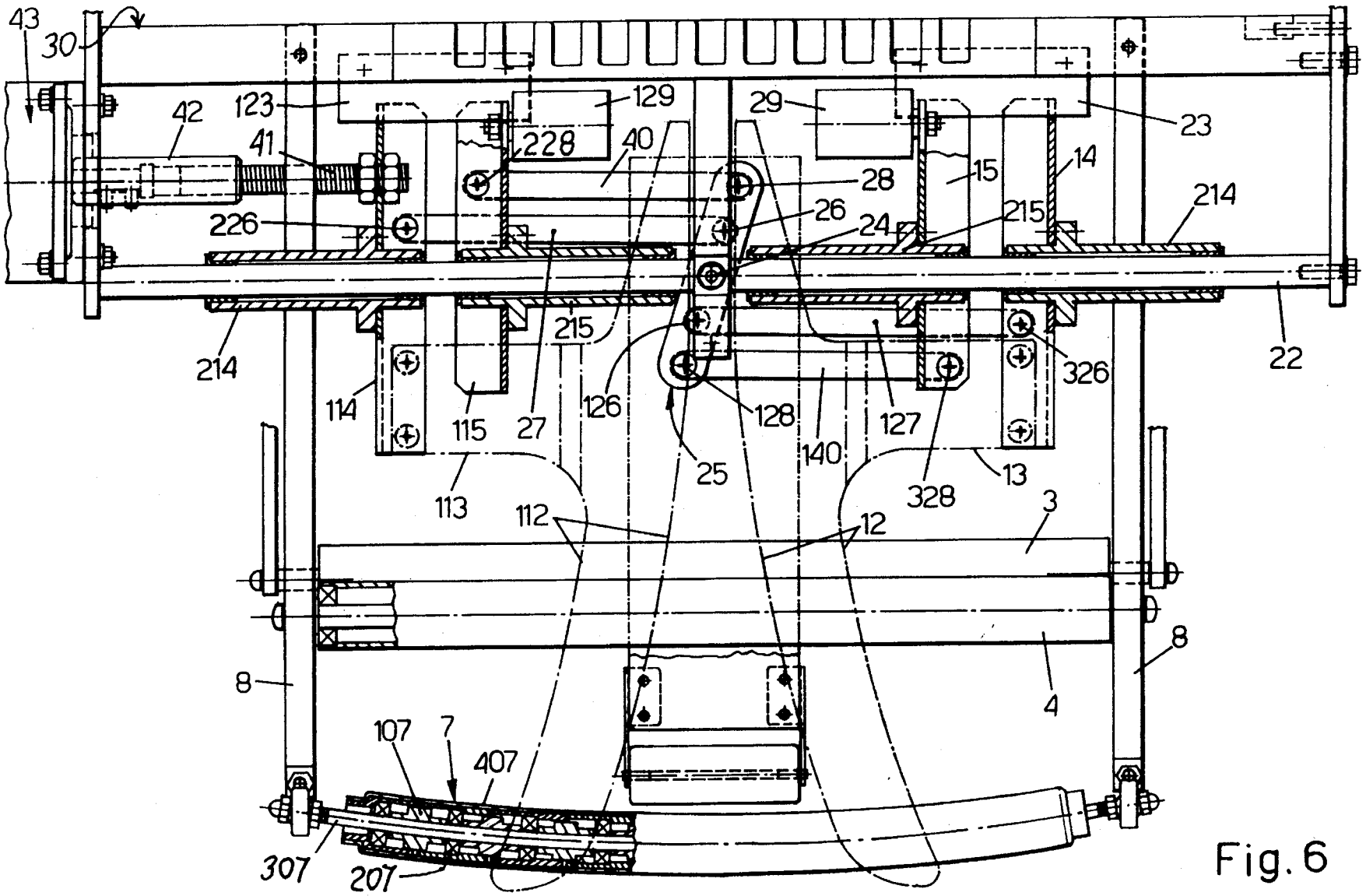
FIG. 6 is a top plan view and in partial section of a simplified alternative embodiment of the pleating device.

FIG. 6 shows a simplified variant of the pleating device, in which the pleating guides 12-112 are made with flat plates shaped as indicated by the dot and dash line. The supports 14-114 of the movable guides 12-112 and the supports 15-115 of the rollers 29-129 slide with the corresponding bushes 214 and 215 on a shaft 22 and interact with fixed guides 23-123 which prevent their rotation about the said shaft. Under the support 10 there is a lever 25, having its fulcrum on a vertical pivot 24, and hinged at points 26-126 equidistant from the pivot 24 to links of equal length 27-127 hinged at their other ends at 226-326 to the supports 14-114 of the movable pleating guides 12-112. The same lever 25 is hinged, at points 28-128 equidistant from the fulcrum 24 and at a distance from it twice as great as the distance between the fulcrum and the hinge point 26, to links of equal length 40-140, with their other ends hinged at 228-328 to the supports 15-115 of the rollers 29-129. The support 114 is fixed to a screw 41 which interacts with a nut 42 keyed to the axle of a small geared motor unit 43 comprising a reversible electronically controlled motor, controlled by the computer 6. It is evident that the movement imparted by means of the screw and nut system 41-42 to the support 114 and through the link 27 to the lever 25 is transmitted at the same rate to the other support 14 of the pleating guides, and is transmitted at twice the rate to the supports 15-115 of the rollers 29-129.

It is to be understood that the description refers to a preferred embodiment of the invention, to which numerous variations and modifications may be made, particularly as regards construction, which may for example be concerned with the fact that the pleating is done with a transverse shaping of the film in the form of an inverted "omega", with consequent inversion of the means described, or with a fretted profile, which requires the use of a plurality of fixed guides 9 with corresponding movable guides 12-112. All this will present no difficulties of design or construction to those skilled in the art. As already mentioned in the introduction, it must be remarked that the width of the stretchable film F used in connection with the wrapping operation, and supplied by the supply roll B must be calculated to be proportionate to that of the largest size of articles which can be handled in the wrapping operation. As a further requirement, the said width of the stretchable film F must be such that the wrapping of articles of the smallest size requires an at least minimum stretching of said film in at least one direction over the article to obtain a sufficiently tight packaging. By way of example, referring to FIG. 1, whenever the side clamps 59-178 move away from each other gripping the side edges of the film, the pleats which have been previously formed by the pleating device are "stretched" and disappear above the article, and in the successive phases of lifting the article against the film and of folding the side flaps of the film under the base of the article, there must take place at least a minimum stretching (even a simple tensioning can be assimilated to a minimum stretching) of the film in the transverse direction, to ensure a tight packaging of the article.

We claim:

1. A process for wrapping a plurality of articles each having different dimensions using a stretchable film comprising the steps of:

determining the largest width dimension of said plurality of articles to be wrapped;

measuring dimensions of the specific article to be wrapped;

adapting width of the film proportionally to sections of the said specific article having smaller widths than said largest width dimension by forming pleats in said film in a direction longitudinal to a length of the film; and feeding said pleated film to a wrapping station where said film is folded onto the article.

2. An apparatus for wrapping articles having different dimensions using a stretchable film comprising;

means for determining the largest width dimension of said plurality of articles to be wrapped;

measuring means for measuring dimensions of the specific article to be wrapped;

pleating means for adapting width of the film proportionally to sections of the said specific article having smaller widths than said largest width dimension by forming pleats in said film in a direction longitudinal to a length of the film; and feeding means for receiving the film from the pleating means and feeding said pleated film to a wrapping station, including means for folding said film onto the article.

3. The apparatus according to claim 2 wherein the pleating means comprises:

at least one long flat fixed longitudinal median guide on which or under which a median portion of the roll slides longitudinally;

corresponding side pleating guides for folding flaps of the film under or above said longitudinal median guide to form partly folded flaps, said side pleating guides projecting laterally from said longitudinal median guide;

modifying means connected to said corresponding side pleating guides for modifying distance between said side pleating guides by a self-centering movement;

clamping means positioned near an end of said longitudinal median guide for controlling the partly folded flaps of the film leaving said longitudinal median guide such that the film is longitudinally slidable between the clamping means substantially without friction;

changing means connected to said clamping means for changing distance between said clamping means by a self-centering movement; and synchronizing means for synchronizing said self-centering movements of said modifying means and said changing means.

4. The apparatus according to claim 3 wherein said feeding means comprises a dispenser and said clamping means comprises at least one rubber-covered roller for each of said partly folded flaps of film, each of said rollers having its axis parallel to the dispenser.

5. The apparatus according to claim 4 further comprising a smooth-surfaced roller, connected in parallel to the rubber-covered rollers and being freely rotatable, for maintaining contact of the partly folded flaps of film with said rubber-covered rollers while not opposing longitudinal movement of the film towards the wrapping machine and transverse movement of the film following the self-centering movement of the changing means and of the modifying means.

6. The apparatus according to claim 5 wherein the smooth-surfaced roller is disposed above the film and supported by oscillating arms, ends of said smooth-surfaced roller being connected to said arms by springs for enabling the smooth-surfaced roller to be raised for initial insertion of the film between rollers and lowered for contacting the film.

7. The apparatus according to claim 4 further comprising a supporting body for supporting the longitudinal median guide, said body including a lever on a lower part thereof having a fulcrum on a vertical pivot, said lever being hinged at first points an equal distance from said pivot to ends of a first pair of links of equal length, said first pair of links being hinged at their other ends to guide supports for the side pleating guides, said guide supports being movable along a shaft parallel to the dispenser, said lever being hinged to ends of a second pair of links at second points equidistant from the pivot and at distances from said pivot twice as great as a distance from said pivot to said first points, said second pair of links having their other ends hinged to roller supports for the rubber-covered rollers which slide on the shaft parallel to the dispenser, said roller supports or guide supports being connecting to control means for controlling movement thereof.

8. The apparatus according to claim 7 wherein one of said roller supports or said guide supports includes a screw connected to a nut on the control means, said control means comprising a driving geared motor unit having an electric motor with two directions of rotation, said motor being controlled by a computer for adapting the film to dimensions of an article to be wrapped.

9. The apparatus according to claim 3 further comprising horizontal supporting wings facing outward from said longitudinal median guide and fixed at a first end to supports connected to the modifying means and connected at a second end to said side pleating guides, the longitudinal median guide projecting outward from the feeding means and having a first end for carrying a freely rotatable roller for facilitating entry of the film such that the film slides on an upper part of the longitudinal median guide toward a second, tapered end of the longitudinal median guide oriented towards the dispenser.

10. The apparatus according to claim 3 wherein the changing means and the modifying means include supports having nuts thereon for interacting with corresponding threaded sections of a single shaft positioned parallel to the dispenser and connected to a driving geared motor unit having an electric motor with two directions of rotation, said motor being controlled by a computer for adapting the film to dimensions of an article to be wrapped.

11. The apparatus according to claim 3 further comprising extending means positioned between a supply source roll for the film and the side pleating guides for extending the film transversely and for preventing formation of uncontrolled folds in the film, said extending means comprising a composite curved roller having a curved fixed axle on which identical rollers are rotatably mounted adjacent one another and including bearings interposed between rollers, said rollers being covered in a common sheath of elastic material, the film being run around a convex part of the sheath, whereby the sheath is extended longitudinally in its passage from a concave to the convex part of the sheath and subjects the film to a necessary extension in the transverse direction.

* * * * *